US006886457B2

(12) United States Patent
Shoji

(10) Patent No.: US 6,886,457 B2
(45) Date of Patent: May 3, 2005

(54) STENCIL SHEET TRANSFER METHOD OF STENCIL PRINTING MACHINE

(75) Inventor: Hideo Shoji, Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 786 days.

(21) Appl. No.: 09/780,611

(22) Filed: Feb. 12, 2001

(65) Prior Publication Data

US 2001/0013285 A1 Aug. 16, 2001

(30) Foreign Application Priority Data

Feb. 14, 2000 (JP) ..... 2000-035421

(51) Int. Cl.[7] ..... B41C 1/14
(52) U.S. Cl. ..... 101/128.4; 101/116
(58) Field of Search ..... 101/114, 115, 101/116, 128.1, 128.4, 129, 484

(56) References Cited

U.S. PATENT DOCUMENTS 5,613,437 A * 3/1997 Motoe et al. ..... 101/128.4
6,334,387 B1 * 1/2002 Motoe ..... 101/116
6,499,394 B1 * 12/2002 Kawagoe et al. ..... 101/128.1
6,520,078 B1 * 2/2003 Motoe ..... 101/116

FOREIGN PATENT DOCUMENTS

EP 0 897 807 2/1999

* cited by examiner

*Primary Examiner*—Ren Yan
(74) *Attorney, Agent, or Firm*—Manabu Kanesaka

(57) ABSTRACT

In perforating a stencil sheet, platen motor and feed motor are driven and thermosensitive perforation of the stencil sheet is started. From the state, the platen motor is driven continuously for γ second. When upstream side stencil sheet awaiting sensor is made ON and α second has elapsed, speed of platen motor is controlled to reduce and actual perforation speed is made constant. Thereafter, when downstream side stencil sheet awaiting sensor is made ON and α second has elapsed, feed motor is made OFF and stopped and lower side movable guide plate is moved to lower limit position by driving downstream side movable guide motor. Thereafter, when downstream side movable guide plate lower limit sensor is made ON, feed motor is made ON and driven again. When downstream side stencil sheet feed sensor is made ON and δ second has elapsed, feed motor is made OFF and stopped.

3 Claims, 11 Drawing Sheets

STENCIL SHEET TRANSFER METHOD OF STENCIL PRINTING MACHINE

BACKGROUND OF THE INVENTION AND RELATED ART STATEMENT

The present invention relates to a stencil sheet transfer method of an apparatus for carrying out stencil printing by thermosensitively perforating a desired image to a stencil sheet and transcribing ink from perforated portions of a stencil area of the thermosensitively perforated stencil sheet onto a print sheet. Particularly, the present invention relates to a stencil sheet transfer method of the apparatus suitable for a case of carrying out stencil printing of a desired image by multiple colors.

There has already been known a stencil printing apparatus for carrying out desired printing by mounting stencil sheet thermosensitively perforated with a desired image onto a drum in a cylindrical shape and making ink supplied from inside of the drum transcribe onto a print sheet by permeating the ink from perforated portions of the stencil sheet.

According to a stencil printing machine of this kind, the stencil sheet wound in a shape of a roll is transferred between a thermal head and a platen roller constituting a perforating section. The stencil sheet is transferred by a platen motor for driving the platen roller. Further, the stencil sheet is perforated by thermosensitive perforation by the thermal head. The perforated stencil sheet is transferred toward a drum by a stencil sheet feeding section constituted by transfer rollers and the like. Further, the stencil sheet is wound around a peripheral wall of the drum and is set. When the perforated stencil sheet is set to the peripheral wall of the drum, ink is supplied from inside of the drum to a surface of the peripheral wall in accordance with rotation of the drum. Further, the ink is pushed out from the perforated portions of the perforated stencil sheet.

When a print sheet supplied from a sheet supply base is made to pass between the peripheral wall of the drum and a press roller applied with predetermined pressure in synchronism with the above-described operation, the ink is transcribed onto the print sheet by passing through the perforated portions of the perforated stencil sheet. Thereby, the print sheet is printed with desired image and the printed print sheet is discharged to a print sheet discharge base.

In the meantime, according to the above-described stencil printing machine, in transferring the stencil sheet to the drum, there is adopted a technology of differentiating stencil drive speed of a perforating section from transfer speed of a stencil sheet transferring section in order to prevent meandering.

Generally, according to the stencil printing machine, the transfer speed of the stencil sheet transferring section is set to be faster than the stencil drive speed of the perforating section. Therefore, perforating operation is carried out at the perforating section while exerting pertinent tension to the stencil sheet by the stencil sheet transferring section. Further, actual stencil speed of the stencil sheet at the perforating section at this occasion, is made to be substantially the same as the stencil drive speed set by a platen motor drive circuit.

However, when a distance of transferring the stencil sheet from the perforating section to the drum is long, the tension of the stencil sheet is increased. Further, the actual stencil speed of the stencil sheet becomes proximate to the transfer speed of the stencil sheet transferring section. Thereby, the stencil sheet is dragged in perforating operation and image elongation is produced.

Further, when there are provided a plurality of drums and the transfer distance of the stencil sheet differs respectively thereby, the stencil speed differs in accordance with the transfer distance, which causes elongation and contraction of image. Further, in carrying out printing of multiple color and multiple edition by using a plurality of drums, when there causes elongation and contraction of image to degrees which differ by respective editions, it becomes impossible to overlap and print all of the editions without shift.

The present invention has been carried out in view of the above-described problem and it is an object thereof to optimize stencil drive speed in perforating operation by detecting a point of passing stencil sheet by a sensor. Further, it is another object thereof to carry out stencil printing having excellent reproducibility by reducing elongation and contraction of image of the stencil sheet thereby.

SUMMARY OF THE INVENTION

In order to achieve the above-described object, according to a first aspect of the present invention, there is provided a stencil printing machine comprising:

a perforating section 4 comprising a thermal head 31 and a platen roller 32 provided at a position opposed to the thermal head 31 for perforating a desired image while transferring stencil sheet 2 by driving to rotate the platen roller 32;

a drum 5 (5B) in a cylindrical shape to which the stencil sheet 2 perforated by the perforating section 4 can be set;

a transfer section for transferring the perforated stencil sheet 2 at a predetermined speed on a transfer path 49 between the perforating section 4 and the drum 5 (5B) in the cylindrical shape;

detecting means 44, 48 for detecting passing of the stencil sheet 2 at predetermined positions of the transfer path 49; and control means 61 for controlling to reduce a speed of driving the platen roller 32 in the perforating section 4 when the detecting means 44, 48 detects passing of the stencil sheet.

According to a second aspect of the present invention, there is provided a stencil printing machine comprising:

a perforating section 4 comprising a thermal head 31 and a platen roller 32 provided at a position opposed to the thermal head 31 for perforating a desired image while transferring stencil sheet 2 by driving to rotate the platen roller 32;

a plurality of drums 5A and 5B in a cylindrical shape around which the perforated stencil sheet 2 can be wound;

a transfer path comprising a common transfer path 49 used commonly for all of the drums 5A, 5B when the perforated stencil sheet 2 is transferred to and wound around any one of the drums and a noncommon transfer path 56 communicated with the common transfer path 49;

a transfer section for transferring the perforated stencil sheet 2 at a predetermined speed on the transfer path;

detecting means 44, 48, 52, 55 for detecting passing of the stencil sheet 2 at predetermined positions of the transfer path; and control means 44, 48, 52, 55 for controlling to reduce a speed of driving the platen roller 32 at the perforating section 4 when the stencil sheet 2 is determined to transfer to a boundary between the common transfer path 49 and the noncommon transfer path 56 by a detecting signal of the detecting means 44, 48, 52, 55.

According to a third aspect of the present invention, in the stencil printing machine according to the second aspect, there is provided the stencil printing machine:

wherein the common transfer path 49 comprises:

upstream side fixed guide plates 41, which are communicated with the perforating section 4 and which are arranged to be opposed to each other at an interval therebetween capable of passing the stencil sheet 2; and upstream side movable guide plates 46, which are communicated to other end sides of the upstream side fixed guide plates 41 and which are arranged to be opposed to each other at an interval therebetween capable of passing the stencil sheet 2 to communicate to the noncommon transfer path 56 or a clamp mechanism 7 of the drum 5B; and wherein the noncommon transfer path 56 comprises:

downstream side fixed guide plates 50, which are communicated to the common transfer path 49 and which are arranged to be opposed to each other at an interval therebetween capable of passing the stencil sheet 2; and downstream side movable guide plates 53 one end sides of which are communicated to other end sides of the downstream side fixed guide plates 53 and other end sides of which are arranged to be opposed to each other at an interval therebetween capable of passing the stencil sheet 2 to be capable of communicating to the clamp mechanism 7 of the drum 5A.

According to a fourth aspect of the present invention, there is provided a stencil sheet transfer method of a stencil printing machine, comprising the steps of:

perforating a desired image while transferring stencil sheet 2;

transferring the perforated stencil sheet 2 at a predetermined speed on a transfer path 49 of the stencil sheet 2;

detecting passing of the stencil sheet 2 at predetermined positions of the transfer path 49 and reducing a speed of transferring the stencil sheet 2; and winding the stencil sheet 2 around a drum 5 in a cylindrical shape.

According to a fifth aspect of the present invention, there is provided a stencil sheet transfer method of a stencil printing machine comprising the steps of:

perforating a desired image by transferring stencil sheet 2;

transferring the perforated stencil sheet 2 at a predetermined speed on a transfer path of the perforated stencil sheet comprising a common transfer path 49 used commonly by all of drums 5 when the perforated stencil sheet 2 is transferred to and wound around any one of a plurality of the drums 5A, 5B in a cylindrical shape and a noncommon transfer path 56 communicated with the common transfer path 49;

detecting passing of the stencil sheet 2 at the common transfer path 49 and the noncommon transfer path 56 and reducing a transfer speed of the stencil sheet 2 when the stencil sheet 2 is determined to be transferred to a boundary between the common transfer path 49 and the noncommon transfer path 56; and winding the stencil sheet 2 around the drums 5 in a cylindrical shape.

DETAILED DESCRIPTION OF THE PREFERRED EMBODIMENTS

Figure 1:
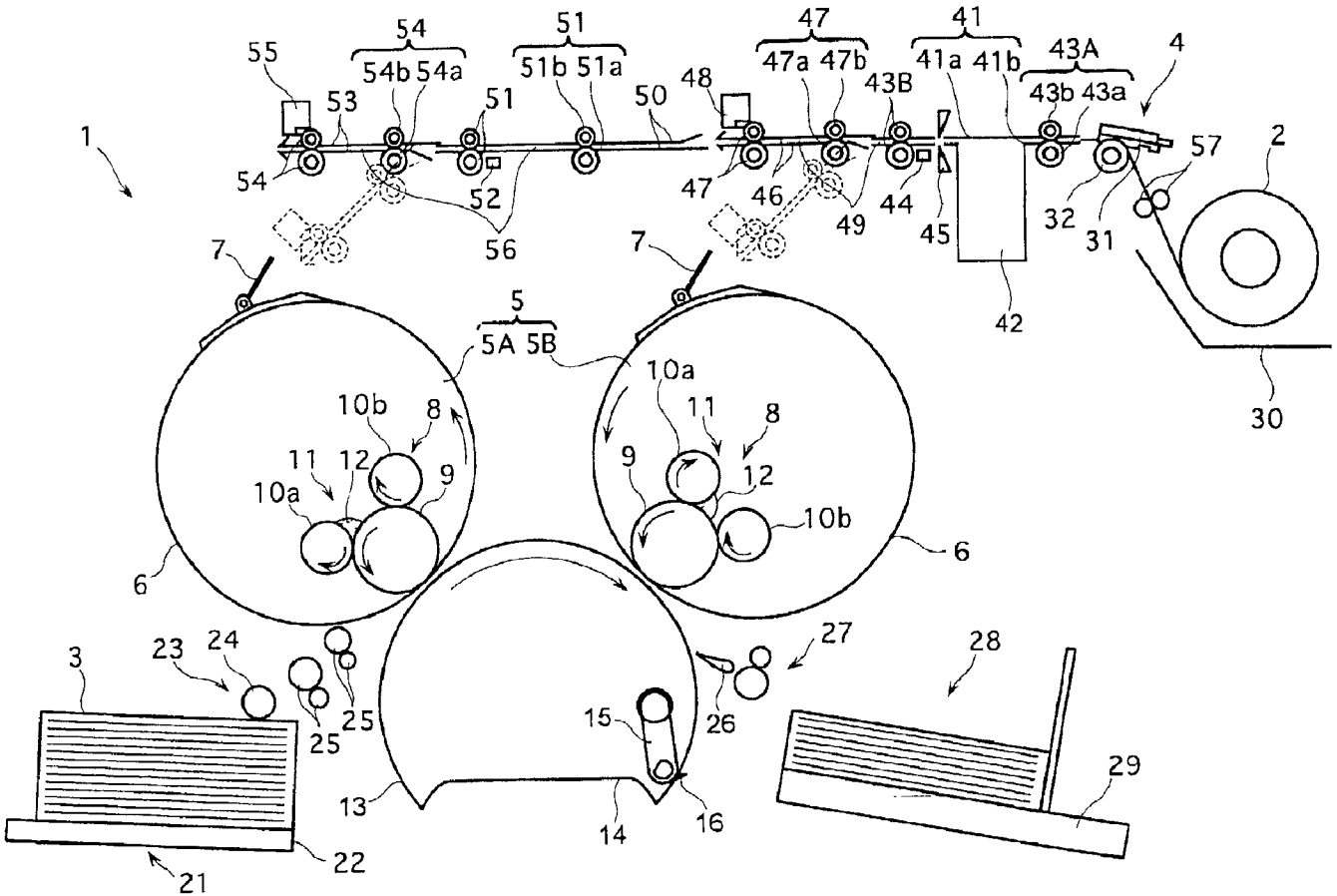
FIG. 1 is a view showing an outline constitution of a stencil printing machine according to the present invention.

FIG. 1 is a view showing an outline constitution of a stencil printing machine according to the present invention. An explanation will be given of a total constitution of a stencil printing machine in reference to FIG. 1 as follows. A stencil printing machine 1 is provided with both of a perforating function for thermosensitively perforating desired image to stencil sheet 2 and a printing function for stencil-printing print sheet 3 by using the perforated stencil sheet 2. There is used sheet constituted by pasting a porous supporter on a thermosensitive film for the stencil sheet 2 as a recording member.

As shown by FIG. 1, the stencil printing machine 1 is provided with a single perforating section 4, mentioned later, and two drums 5 (first drum 5A, second drum 5B) in a cylindrical shape rotatably supported around central axis lines of their own. The stencil printing machine 1 carries out stencil printing of desired image in one printing operation by using two colors of print ink. In this case, one of the drums remote from the perforating section 4 on the left side of FIG. 1 is the first drum 5A and other thereof proximate to the printing section 4 on the right side of FIG. 1 is the second drum 5B.

Peripheral walls 6 of the respective drums 5A and 5B are constituted in a porous structure substantially in a cylindrical shape. Each of the peripheral walls 6 is provided with a clamp mechanism 7 for locking one end of the stencil sheet 2 at an outer peripheral portion thereof. The respective drums 5A and 5B are driven to rotate intermittently or continuously in the counterclockwise direction of FIG. 1 by power of printing drum drive motors, not illustrated.

As shown by FIG. 1, print ink supply means 8 is provided at inside of the peripheral wall 6 of each of the drums 5A and 5B. The print ink supply means 8 is arranged such that an outer peripheral face thereof is brought into contact with an inner peripheral face of the peripheral wall 6. The print ink supply means 8 are provided with squeegee rollers 9 rotatable around central axes of their own and pairs of doctor rollers 10*a* and 10*b*. The doctor rollers 10*a* and 10*b* are extended along generating line directions of the squeegee rollers 9 at predetermined intervals from outer peripheral faces of the squeegee rollers 9. According to the print ink supply means 8, by driving to rotate the squeegee roller 9 in a direction the same as that of the drum 5A (or drum 5B) in synchronism with the drum 5A (or drum 5B), print ink 12 at an ink storage 11 is supplied to the inner peripheral face of the peripheral wall 6. The squeegee roller 9 is moved to bulge the peripheral wall 6 from an inner side thereof to an outer side in the diameter direction in printing operation by a mechanism, not illustrated.

Further, according to the stencil printing machine 1 shown in FIG. 1, in order to carry out multiple color printing by two colors, inks having different colors are used for the print ink 12 of the first drum 5A and the second drum 5B.

The print ink 12 at the ink storage 11, passes through a clearance between squeegee roller 9 and the doctor roller 10*a* in accordance with rotation of the squeegee roller 9 and forms a print ink layer having a uniform thickness at the outer peripheral face of the squeegee roller 9. The print ink layer is supplied to the inner peripheral face of the peripheral wall 6 in accordance with rotation of the squeegee roller 9 and subjected to printing. Further, the doctor roller 10*b* prevents ink from leaking from a clearance between the doctor roller 10*b* and the squeegee roller 9 when the drum 5B is left for a long period of time.

A single paper drum 13 is provided at outer side positions of the respective drums 5A and 5B as a roller member. The paper drum 13 is arranged such that an outer peripheral face thereof is proximate to portions of outer peripheral faces opposed to the squeegee rollers 9 of the peripheral walls 6 of the respective drums 5A and 5B. The paper drum is formed by a nonelastic material such as metal. The paper drum 13 is formed in an outer shape substantially the same as those of the peripheral walls of the respective drums 5A and 5B. A peripheral wall of the paper drum 13 is provided in parallel with the peripheral walls 6 of the respective drums 5A and 5B at predetermined intervals therebetween by a central axis thereof. Further, the paper drum 13 is provided with a recess portion 14 for avoiding interference with the clamp mechanism (clamp plates or clamp base plates) at the peripheral walls 6 of the respective drums 5A and 5B. The respective drums 5A and 5B and the paper drum 13 are constituted such that the outer peripheral faces thereof are brought into press contact with each other in accordance with above-described movement of the squeegee rollers 9 in printing operation.

The paper drum 13 is provided with a sheet clamp member 15. The sheet clamp member 15 is pivotably mounted to the paper drum 13 by an axial shaft (not shown). One end of the sheet clamp member 15 is provided with a clamp piece 16 for attachably and detachably clamping the print sheet 3 in cooperation with the outer peripheral face of the paper drum 13.

Further, although not illustrated, the paper drum 13 is provided with a cam mechanism for clamping or releasing the print sheet 3.

In FIG. 1, a sheet supply section 21 is provided on a left lower side of the paper drum 13. The sheet supply section 21 is provided with a sheet supply base 22 for loading the print sheet 3. The sheet supply base 22 is moved in an up and down direction by a drive apparatus, not illustrated, in accordance with an amount of loading the set print sheet 3.

A sheet supply mechanism 23 is provided at a vicinity of the sheet supply base 22. The sheet supply mechanism 23 comprises a sheet supply roller 24 comprising rubber and a plurality of sets of transfer rollers 25. The sheet supply roller 24 picks up, sheet by sheet, a topmost one of the print sheet 3 loaded on the sheet supply base 22 and transfers the sheet to the transfer rollers 25 side. The transfer rollers 25 feed the print sheet 3 fed from the sheet supply roller 24 to between the peripheral wall 6 of the first drum 5A and the paper drum 13 at pertinent timings.

In FIG. 1, a print sheet separating claw 26 is provided on a lower side of the second drum 5B and at a vicinity of the outer peripheral face of the paper drum 13. The print sheet separating claw 26 is for removing the print sheet 3 which has been printed from on the paper drum 13. The printed print sheet 4 which is separated by the print sheet separating claw 26, is transferred to a print sheet discharge section 28 by a print sheet discharge apparatus 27 constituted by illustrated roller pair, belt conveyer or the like. The print sheet discharge section 28 is provided with a print sheet discharge base 29 for loading and containing the printed print sheet 3 transferred by the print sheet discharge apparatus 27.

In FIG. 1, on a right upper side of the print sheet discharge section 28, the stencil sheet 2 in continuous sheet wound in a roll-like shape is stored in a storing section 30. The stencil sheet 2 is applied with predetermined tension by a tension applying apparatus, not illustrated, such that brake force (brake) is operated to a winding core in a state set to the storing portion 30.

In FIG. 1, the perforating section 4 is provided at a vicinity and on a downstream side of the storing section 30 storing the stencil sheet 2. The perforating section 4 is provided with a thermal head 31 and a platen roller 32 opposed to the thermal head 31. The platen roller 32 transfers the stencil sheet 2 by a platen motor 66 driven via a platen motor drive circuit 67 by instruction from control means 61, mentioned later. Further, the perforating section 4 thermosensitively perforates the stencil sheet 2 transferred from the storing section 30 by rotation of the platen roller 32, by the thermal head 31.

The thermal head 31 is arranged with a number of heat generating elements for selectively generating heat in accordance with image data read by an original document reading section, not illustrated, or an image signal of image data transferred from an outer apparatus, at constant intervals in a transverse row, that is, in a main scan direction. The thermal head 31 is formed in a shape of a slender plate and is installed in contact with an upper face of the transferred stencil sheet 2 in parallel with a width direction (main scan direction) of the stencil sheet 2. The thermal head 31 is made movable in a direction of approaching the platen roller 32 or separating therefrom. That is, the thermal head 31 is brought into contact with the platen roller 32 in perforating the stencil sheet 2 and is separated from the platen roller 32 when the stencil sheet 2 is not perforated.

In FIG. 1, in view from the storing section 30, on the downstream side of the perforating section 4, there is arranged an upstream side fixed guide plate 41. The upstream side fixed guide plate 41 is constituted by a horizontal upper guide plate 41*a* and a lower guide plate 41*b* in a shape of a channel arranged at an interval therebetween to a degree capable of transferring the stencil sheet 2. A space portion in the channel shape of the lower guide plate 41*b*, is formed with a temporary storing section 42 for slackening and storing the stencil sheet 2 when the stencil sheet 2 is set to the second drum 5B.

Transfer rollers 43A and 43B are arranged at both end portions of the upstream side fixed guide plate 41. Each of the transfer rollers 43A and 43B is constituted by a driving roller 43*a* and a driven roller 43*b* for transferring the stencil sheet 2 to the drum 5 side. In FIG. 1, at a vicinity of the upstream side of the transfer roller 43B on the left side of the upstream side fixed guide plate 41, there is arranged an upstream side stencil sheet awaiting sensor 44 as detecting means for detecting passing of the transferred stencil sheet 2. Between the upstream side stencil sheet awaiting sensor 44 and the temporary storing section 42, there is arranged a cutter apparatus 45 for cutting the stencil sheet 2 finished with perforation of desired image.

On the downstream side of the upstream side fixed guide plate 41, there is arranged an upstream side movable guide plate 46 for communicating and connecting with the upstream side fixed guide plate 41. The upstream side movable guide plate 46 is constituted by two sheets of horizontal guide plates arranged at an interval therebetween to a degree of enabling transfer of the stencil sheet 2. The upstream side movable guide plate 46 can be inclined by a predetermined angle toward the clamp mechanism 7 of the second drum 5B with a side thereof communicating and connecting with the upstream side fixed guide plate 41 as a fulcrum by an upstream side movable guide motor 70 driven via an upstream side movable guide motor drive circuit 71 by instruction from the control means 61, mentioned later. At both end portions of the upstream side movable guide plate 46, there are arranged transfer rollers 47 each comprising a driving roller 47*a* and a driven roller 47*b* for transferring the stencil sheet 2. In FIG. 1, at a vicinity on the downstream side of the transfer roller 47 on the left side of the upstream side movable guide plate 46, there is arranged an upstream side stencil sheet feed sensor 48 as detecting means for detecting passing of the transferred stencil sheet 2.

Further, the upstream side fixed guide plate 41 and the upstream side movable guide plate 46 form a common transfer path 49 commonly used by the first drum 5A and the second drum 5B for transferring the stencil sheet 2 to the respective drums 5A and 5B.

In FIG. 1, on the downstream side of the upper stream side movable guide plate 46 constituting a portion of the common transfer path 49, there is arranged a downstream side fixed guide plate 50 to communicate and connect with the upstream side movable guide plate 46. The downstream side fixed guide plate 50 is constituted by two sheet of horizontal guide plates arranged at an interval therebetween to a degree of capable of transferring the stencil sheet 2.

At a vicinity of the downstream fixed guide plate 50, there are arranged transfer rollers 51. The transfer roller 51 comprises a driving roller 51*a* and a driven roller 51*b* for transferring the stencil sheet 2 to the first drum 5A side. In FIG. 1, at a vicinity of the upstream side of the transfer roller 51 on the left side of the downstream side fixed guide plate 50, there is arranged a downstream side stencil sheet awaiting sensor 52 as detecting means for detecting passing of the transferred stencil sheet 2.

On the downstream side of the downstream side fixed guide plate 50, there is arranged a downstream side movable guide plate 53 communicating and connecting with the downstream side fixed guide plate 50. The downstream side movable guide plate 53 is constituted by two sheets of horizontal guide plates arranged at an interval therebetween to a degree of capable of transferring the stencil sheet 2. The downstream side movable guide plate 53 can be inclined by a predetermined degree toward the clamp mechanism 7 of the first drum 5A with a side thereof communicating and connecting with the downstream side fixed guide plate 50 as a fulcrum by a downstream side movable guide motor 72 via a downstream side movable guide motor drive circuit 73 by instruction from the control means 61, mentioned later. At both end portions of the downstream side movable guide plate 53, there are arranged transfer rollers 54 each comprising a driving roller 54*a* and a driven roller 54*b* for transferring the stencil sheet 2 toward the clamp mechanism 7 of the first drum 5A. In FIG. 1, at a vicinity of the downstream side of the transfer roller 54 on the left side of the downstream side movable guide plate 53, there is arranged a downstream side stencil sheet feed sensor 55 as detecting means for detecting passing of the transferred stencil sheet 2.

Further, the downstream side fixed guide plate 50 and the downstream side movable guide plate 53 form a noncommon transfer path 56 used only for the first drum 5A for transferring the stencil sheet 2 to the first drum 5A. Further, immediately before starting to perforate the stencil sheet 2, as shown by bold lines of FIG. 1, the common transfer path 49 and the noncommon transfer path 56 are brought into a horizontal state.

In FIG. 1, between the storing section 30 and the perforating section 4, there is provided a transfer roller 57 comprising a pair of rollers for transferring the stencil sheet 2. Although not illustrated, the driving rollers 43*a*, 47*a*, 51*a* and 54*a* of the respective transfer rollers 43A, 43B, 47, 51 and 54 in the common transfer path 49 and the noncommon transfer path 56 including the transfer roller 57, are connected to a feed motor 68, mentioned later, via endless belts. Further, a transfer drive section is constituted by the transfer rollers 43, 47, 51, 54 and 57, the endless belts and the feed motor 68 and a feed motor drive circuit 69, mentioned later.

Figure 2:
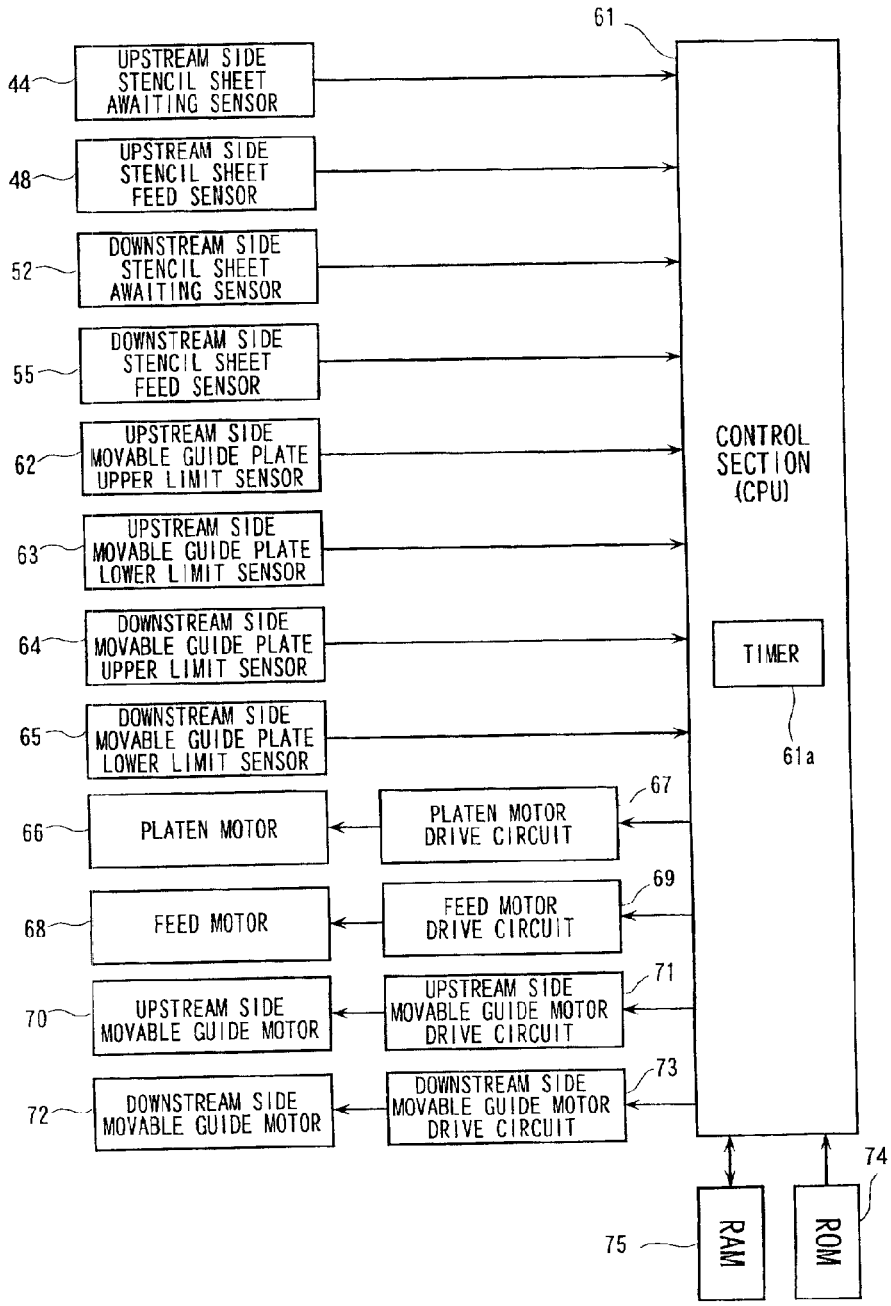
FIG. 2 is a block diagram with regard to stencil sheet transfer control of the stencil printing machine according to the present invention.

Here, FIG. 2 is a block diagram extracting only constitutions for perforating the stencil sheet 2 and setting the perforated stencil sheet 2 to the respective drums.

Explaining respective constitutions in FIG. 2, the upstream side stencil sheet awaiting sensor 44 inputs to the control means 61, a detecting signal indicating that the stencil sheet 2 has passed through inside of the upstream side fixed guide plate 41 of the common transfer path 49 when a front end of the stencil sheet 2 has passed through the upstream side stencil sheet awaiting sensor 44 in transferring the thermosensitively perforated stencil sheet 2 to the first drum 5A side or the second drum 5B side.

The upstream side stencil sheet feed sensor 48 inputs to the control means 61, a detecting signal indicating that the stencil sheet 2 has passed through inside of the upstream side movable guide plate 46 of the common transfer path 49 when the front end of the stencil sheet 2 has passed through the upstream side stencil sheet feed sensor 48 in setting the thermosensitively perforated stencil sheet 2 to the second drum 5B.

The downstream side stencil sheet awaiting sensor 52 inputs to the control means 61, a detecting signal indicating that the stencil sheet 2 has passed through inside of the downstream side fixed guide plate 50 of the noncommon transfer path 56 when the front end of the stencil sheet 2 has passed through the downstream side stencil sheet awaiting sensor 52 in transferring the thermosensitively perforated stencil sheet 2 to the first drum 5A side.

The downstream side stencil sheet feed sensor 55 inputs to the control means 61, a detecting signal indicating that the stencil sheet 2 has passed through inside of the downstream side movable guide plate 53 of the noncommon transfer path 56 when the front end of the stencil sheet has passed through the downstream side stencil sheet feed sensor 55 in setting the thermosensitively perforated stencil sheet 2 to the first drum 5A.

Here, a position of the upstream side movable guide plate 46 in the horizontal state when the upstream side movable guide plate 46 is communicated and connected to the upstream side fixed guide plate 41 and the downstream side fixed guide plate 50, is defined as an upper limit position. An upstream side movable guide plate upper limit sensor 62 detects whether the upstream side movable guide plate 46 is disposed at the upper limit position. Further, a detecting signal at that occasion is inputted to the control means 61.

Further, here, a position of the upstream side movable guide plate 46 in a state in which the upstream side movable guide plate 46 is inclined by the predetermined angle for guiding the thermosensitively perforated stencil sheet 2 to a clamp position of the clamp mechanism 7 of the second drum 5B, is defined as a lower limit position. An upstream side movable guide plate lower limit sensor 63 detects whether the upstream side movable guide plate 46 is disposed at the lower limit position. Further, a detecting signal at that occasion is inputted to the control means 61.

Further, here, a position in the horizontal state in which the downstream side movable guide plate 53 is communicated and connected to the downstream side fixed guide plate 50, is defined as an upper limit position. A downstream side movable guide plate upper limit sensor 64 detects whether the upstream side movable guide plate 53 is disposed at the upper limit position. Further, a detecting signal at that occasion is inputted to the control means 61.

Further, here, a position of the downstream side movable guide plate 53 in a state in which the downstream side movable guide plate 53 is inclined by the predetermined angle for guiding the thermosensitively perforated stencil sheet 2 to a clamp position of the clamp mechanism 7 of the first drum 5A, is defined as a lower limit position. A downstream side movable guide plate lower limit sensor 65 detects whether the downstream side movable guide plate 53 is disposed at the lower limit position. Further, a detecting signal at that occasion is inputted to the control means 61.

The platen motor 66 comprises, for example, a stepping motor. The platen motor 66 drives to rotate the platen roller 32 for transferring the stencil sheet 2 when desired image is thermosensitively perforated to the stencil sheet 2.

The platen motor drive circuit 67 drives to rotate the platen motor 66 at predetermined perforation drive speed by instruction from the control means 61. When the stencil sheet 2 comes to a boundary between the common transfer path 49 and the noncommon transfer path 56, the perforation drive speed is reduced.

The feed motor 68 comprises, for example, a stepping motor. The feed motor 68 drives to rotate the respective transfer rollers 43A, 43B, 47, 51, 54 and 57 by endless belts, not illustrated, for transferring the stencil sheet 2 at predetermined speed in the transfer paths 49 and 56.

The feed motor drive circuit 69 drives to rotate the feed motor 68 at predetermined speed by instruction from the control means 61.

The upstream side movable guide motor 70 moves the upstream side movable guide plate 46 between the horizontal state (upper limit position) and the inclined state (lower limit position).

The upstream side movable guide motor drive circuit 71 drives the upstream side movable guide motor 70 regularly or reversely by instruction from the control means 61.

The downstream side movable guide motor 72 moves the downstream side movable guide plate 53 between the horizontal state (upper limit position) and the inclined state (lower limit position).

The downstream side movable guide motor drive circuit 73 drives the downstream side movable guide motor 72 regularly or reversely by instruction from the control means 61.

ROM 74 as storing means is stored with control programs for controlling operation in flowcharts shown in FIG. 3 through FIG. 5, explained later. Further, RAM 75 as storing means is used for storing operation variables of the control means 61.

The control means (CPU) 61 governs a series of stencil printing operation including thermosensitive perforation of the stencil sheet 2 by desired image, setting the perforated stencil sheet 2 and printing by two colors. The control means 61 inputs signals from the stencil sheet awaiting sensors 44 and 52, the stencil sheet feed sensors 48 and 55, the movable guide plate upper limit sensors 62 and 64 and the movable guide plate lower limit sensors 63 and 65 and controls the operation of the flowcharts shown in FIG. 3 through FIG. 5, explained below, in accordance with the control programs of ROM 74.

The control means 61 is provided with a timer 61*a* for measuring a predetermined time period from when the stencil sheet awaiting sensor (44 or 52) is made ON, a predetermined time period from when the stencil sheet feed sensor (48 or 55) is made ON and a time period of operating the platen motor 66.

Next, an explanation will be given of operation of the stencil printing machine 1 by the above-described constitution in reference to FIG. 3 through FIG. 7. Here, an explanation will be given of operation until the stencil sheet 2 is perforated with desired image and is set to the respective drums 5A, 5B constituting an essential portion of the example.

Figure 3:
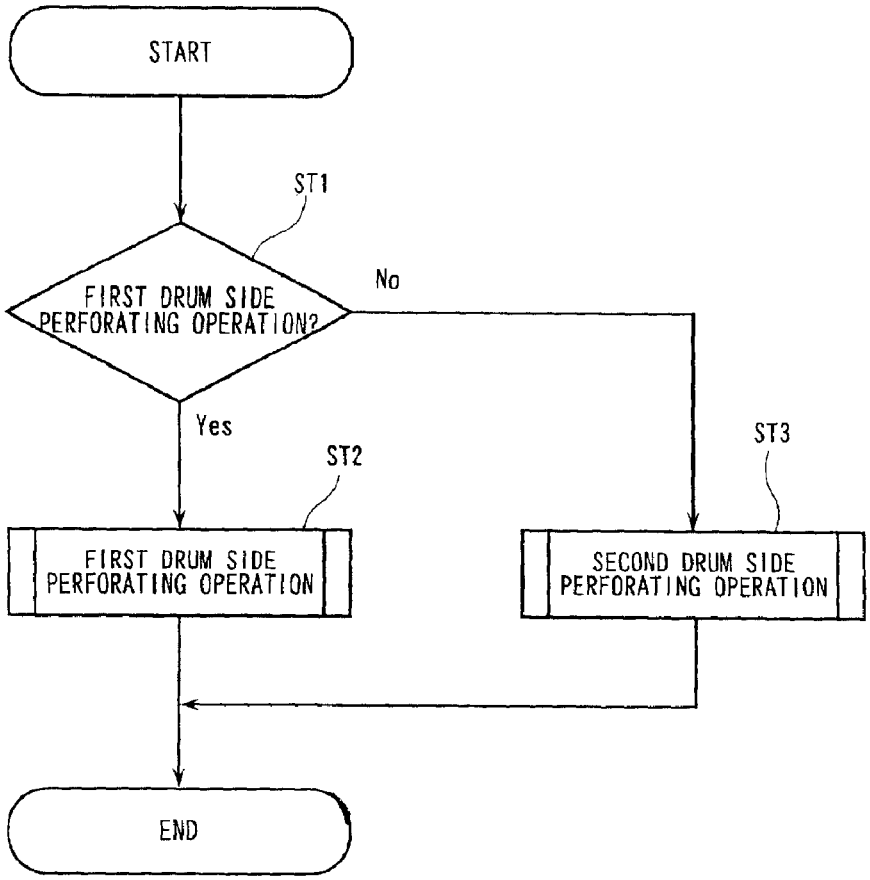
FIG. 3 is a main flowchart with regard to perforating operation of the stencil sheet printing apparatus according to the present invention.
Figure 4:
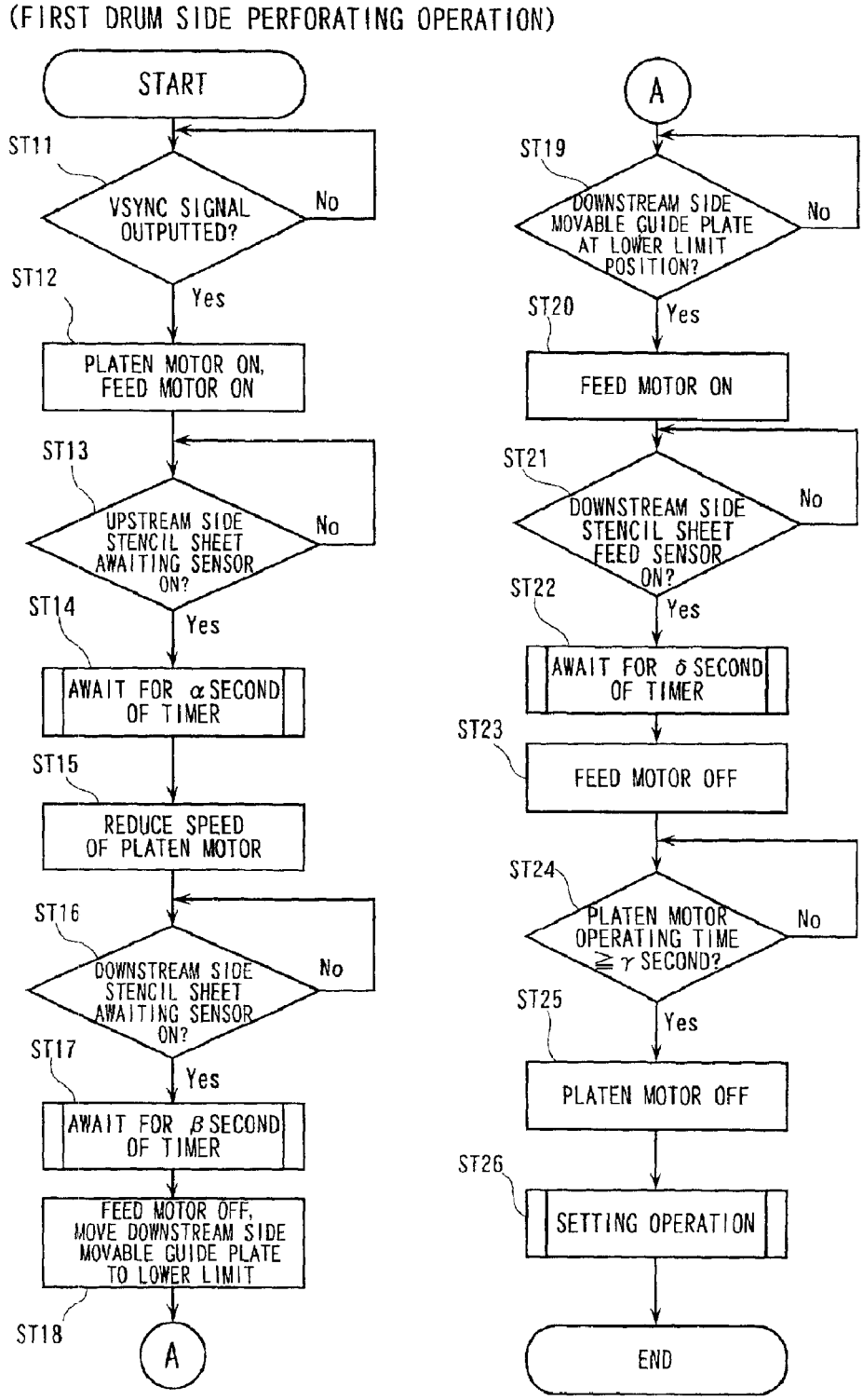
FIG. 4 is a flowchart with regard to perforating operation of a first drum of the stencil printing machine according to the present invention.
Figure 5:
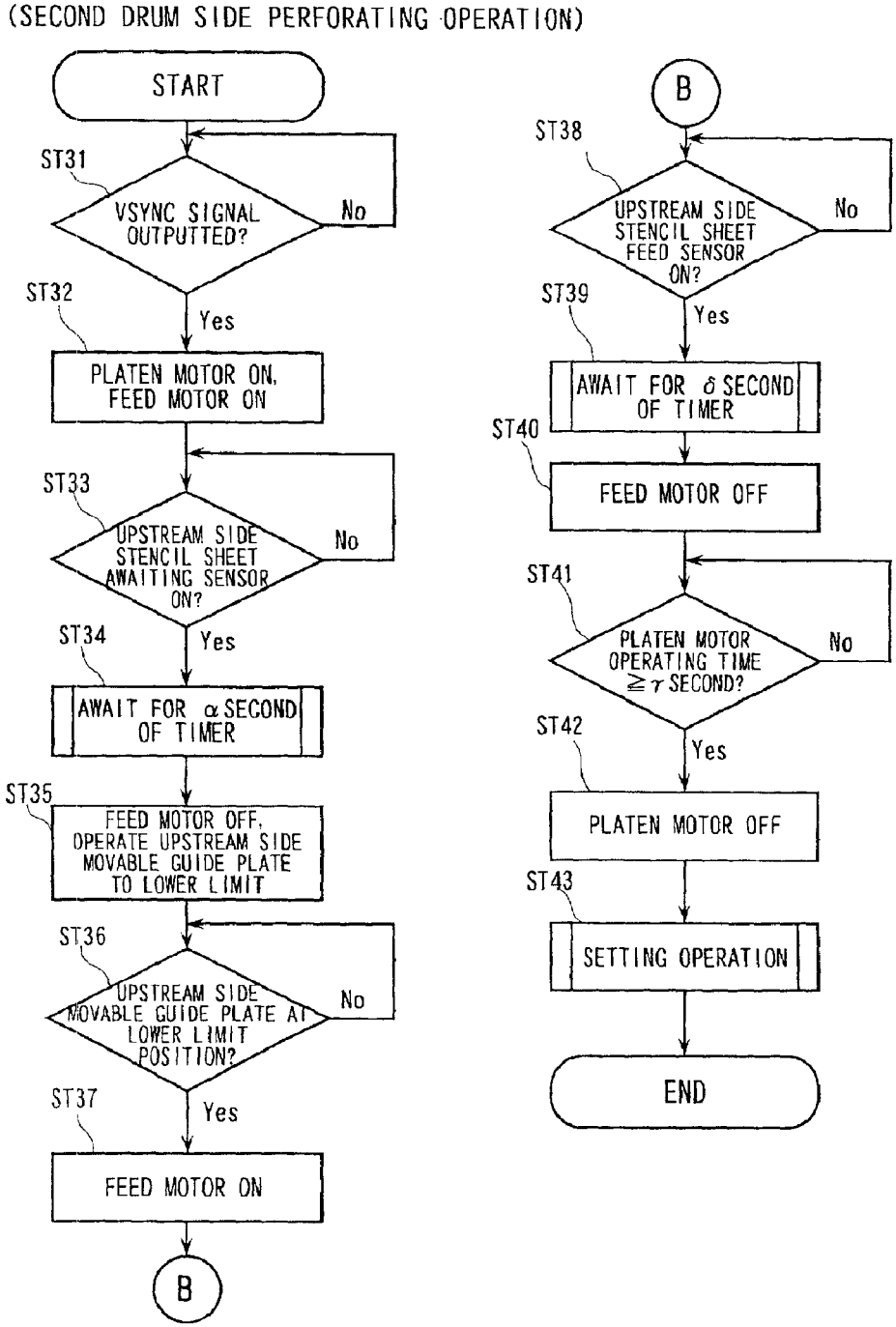
FIG. 5 is a flowchart with regard to perforating operation of a second drum of the stencil printing machine according to the present invention.
Figure 6A:
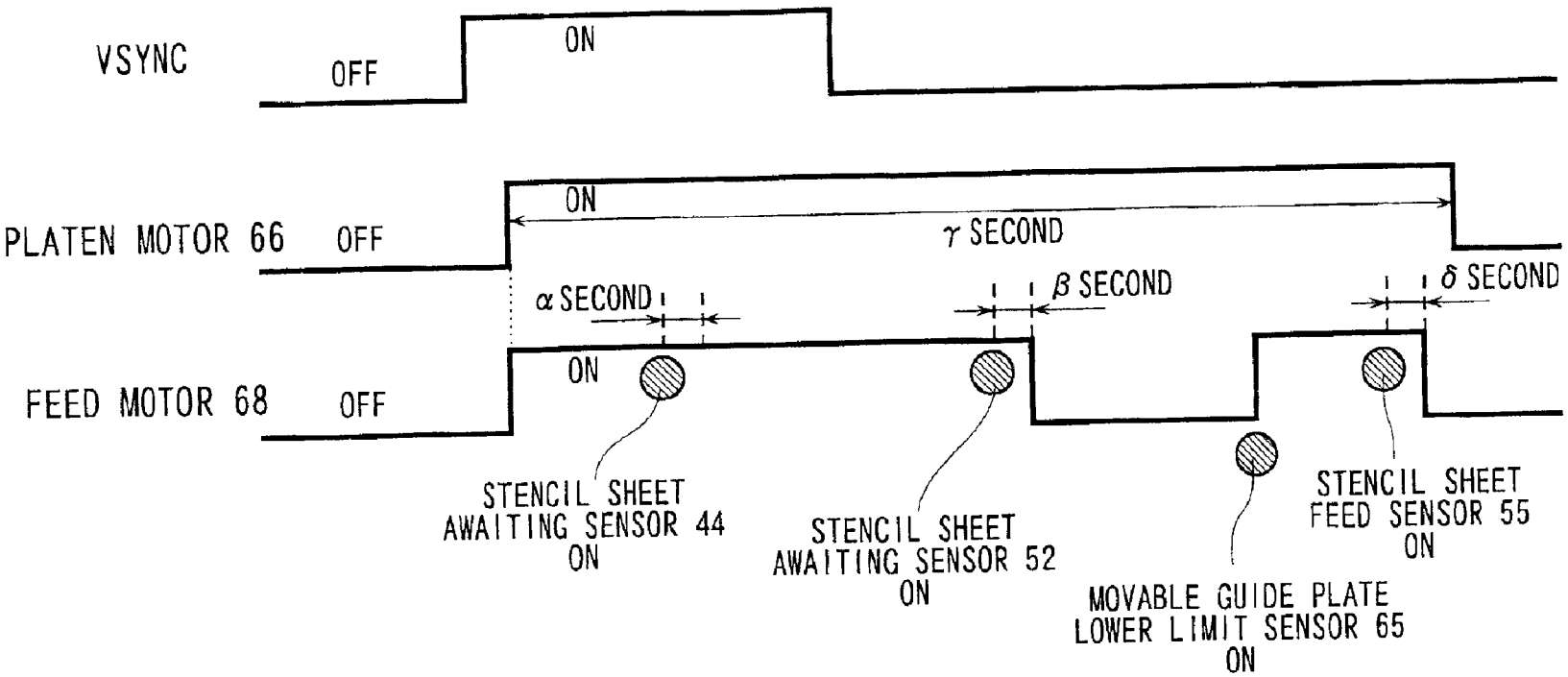
FIG. 6A is a timing chart in perforating operation on a side of a first drum 5A of the stencil printing machine according to the present invention.
Figure 6B:
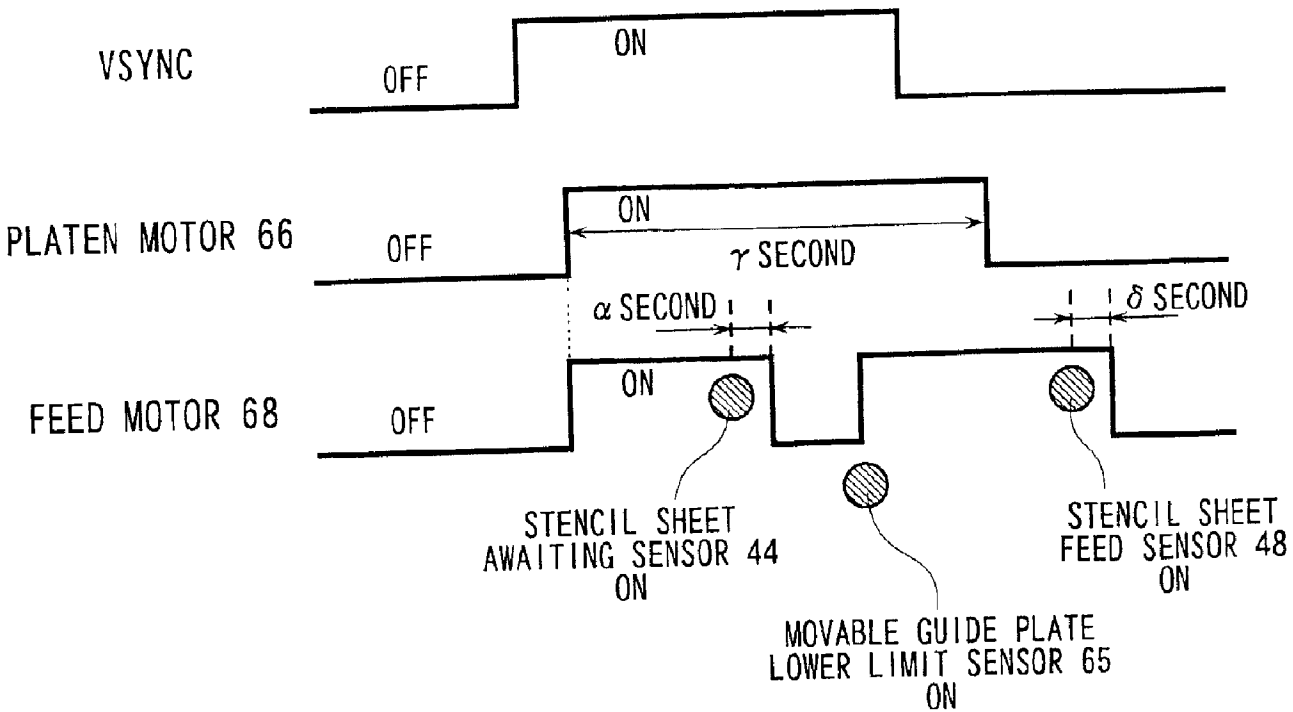
FIG. 6B is a timing chart in perforating operation on a side of a second drum 5B of the stencil printing machine according to the present invention.
Figure 7:
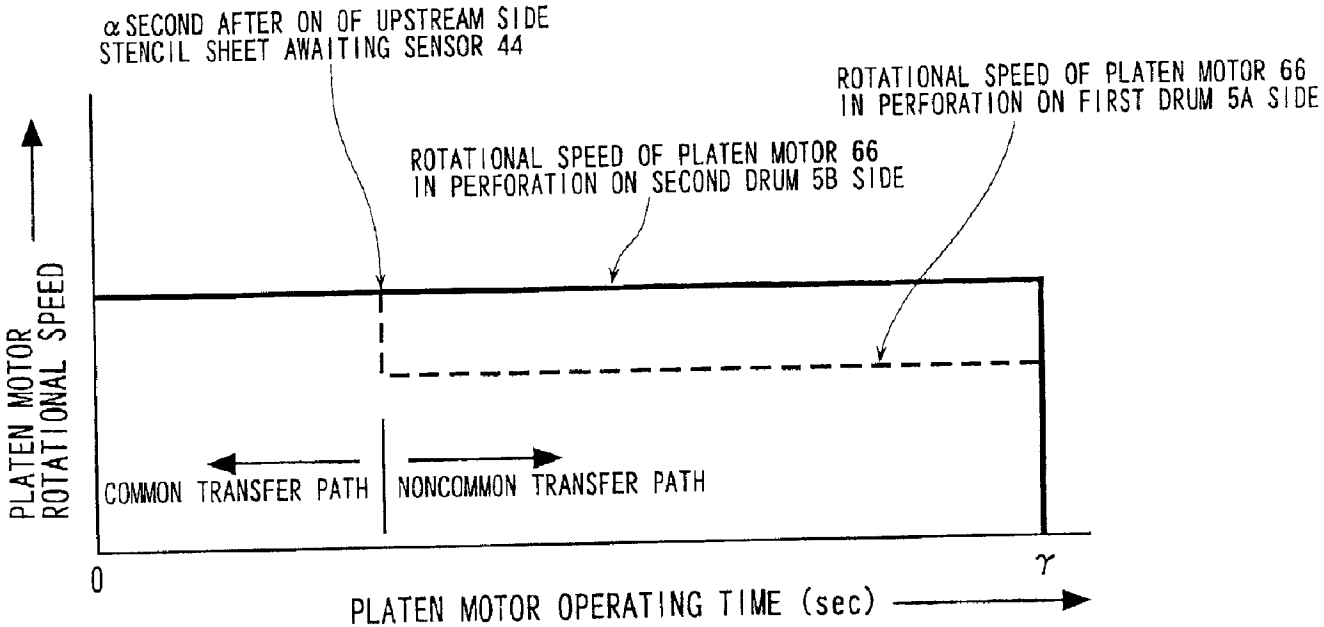
FIG. 7 is a schematic diagram showing operation of platen rollers in perforating operation at the first drum and the second drum of the stencil printing machine according to the present invention.

FIG. 3 is a main flowchart with regard to perforating operation, FIG. 4 is a flowchart with regard to perforating operation of the first drum 5A, FIG. 5 is a flowchart with regard to perforating operation of the second drum 5B, FIG. 6A and FIG. 6B are timing charts in perforating operation and FIG. 7 is a schematic diagram showing operation of the platen motor in perforating operation at the first drum 5A and the second drum 5B.

In an initial state before thermosensitively perforating desired image to the stencil sheet 2, the upstream side movable guide plate upper limit sensor 62 and the downstream side movable guide plate upper limit sensor 64 are made ON. Therefore, as shown by the bold lines of FIG. 1, the two movable guide plates 46 and 53 are disposed horizontally to constitute a straight line along with the two fixed guide plates 41 and 50.

Under the state, the control means 61 monitors respective perforation request command of the first drum 5A and the second drum 5B. Further, the control means 61 carries out perforating operation with regard to the drum 5 when the control means 61 receives the perforation request command.

That is, when the perforation request command for carrying out perforating operation on the first drum 5A side is transmitted (ST1-Yes), perforating operation on the first drum 5A side is executed (ST2). When the perforation request command for carrying out perforating operation on the second drum 5B side is transmitted (STI-No), perforating operation on the second drum 5B side is executed (ST3).

(Perforating operation on first drum 5A side . . . operational flowchart of FIG. 4)

As shown by FIG. 6A, when VSYNC signal as a synchronizing signal is made ON (ST11-Yes), the platen motor 66 and the feed motor 68 are made ON and driven (ST12). Thereby, writing (thermosensitive perforation) of desired image to the stencil sheet 2 is started. From the state, the platen motor 66 is driven continuously for γ second as shown by FIG. 6A and FIG. 7. During the time period, as shown by FIG. 6A, when the upstream side stencil sheet awaiting sensor 44 is made ON (ST13-Yes), the timer 61*a* starts measuring time.

Further, when α second has elapsed at the timer 61*a* (ST14), the stencil sheet 2 enters the noncommon transfer path 56 (first drum 5A side). Under the state, as shown by broken lines of FIG. 7, the perforation drive speed at the platen motor 66 is controlled to reduce (ST15) and actual perforation speed is made to be constant. Specifically, the perforation drive speed of the platen motor 66 when the stencil sheet 2 is transferred at inside of the common transfer path 49, is defined as 100%, the perforation drive speed is reduced by about several % therefrom and is controlled.

After the speed of the platen motor 66 has been reduced, as shown by FIG. 6A, when the downstream side stencil sheet awaiting sensor 52 is made ON (ST16-Yes), the timer 61*a* starts measuring time. Further, when β second has elapsed in the timer 61*a* (ST17), the feed motor 68 is made OFF and stopped. Further, the downstream side movable guide motor 72 is driven and the downstream side movable guide plate 53 is moved to the lower limit position shown by dotted lines of FIG. 1 (ST18).

When the downstream side movable guide plate 53 is moved to the lower limit position and the downstream side movable guide plate lower limit sensor 65 is made ON (ST19-Yes), the feed motor 68 is made ON and is driven again (ST20). Successively, when the downstream side stencil sheet feed sensor 55 is made ON (ST21-Yes), the timer 61*a* starts measuring time. When δ second has elapsed in the timer 61*a* (ST22), the feed motor 68 is made OFF and is stopped (ST23). Further, when a time period of operating the platen motor has elapsed by γ second by measuring time by the timer 61*a* (ST24-Yes), the platen motor 66 is made OFF and is stopped (ST25). Thereafter, the operation proceeds to setting operation (ST26).

In the setting operation, one end of the perforated stencil sheet 2 transferred by the perforating operation, is clamped by the clamp mechanism 7 of the first drum 5A. Successively, the terminal end of the clamped stencil sheet 2 is cut by the cutter apparatus 45. Further, the drum 5A is rotated in the counterclockwise direction of FIG. 1 and the perforated stencil sheet 2 is wound around the peripheral wall 6 of the first drum 5A.

(Perforating operation on second drum 5B side . . . operational flowchart of FIG. 5)

As shown by FIG. 6B, when VSYNC signal as a synchronizing signal is made ON (ST31-Yes), the platen motor 66 and the feed motor 68 are made ON and driven (ST32). Thereby, writing of desired image to the stencil sheet 2 is started. From the state, the platen motor 66 is driven continuously for γ second as shown by FIG. 6B and FIG. 7. During the time period, as shown by FIG. 6B, when the upstream side stencil sheet awaiting sensor 44 is made ON (ST33-Yes), the timer 61*a* starts measuring time.

Further, when α second has elapsed in the timer 61*a* (ST34), the feed motor 59 is made OFF and is stopped. Further, by driving the upstream side movable guide motor 70, the upstream side movable guide plate 46 is moved to the lower limit position shown by dotted lines of FIG. 1 (ST35).

When the upstream side movable guide plate 46 is moved to the lower limit position and the upstream side movable guide plate lower limit sensor 65 is made ON (ST36-Yes), the feed motor 68 is made ON and is driven again (ST37). Successively, when the upstream side stencil sheet feed sensor 48 is made ON (ST38-Yes), the timer 61*a* starts measuring time. When δ second has elapsed in the timer 61*a* (ST39), the feed motor 68 is made OFF and is stopped (ST40). Further, when a time period of operating the platen motor has elapsed by γ second by measuring time by the timer 61*a* (ST41-Yes), the platen motor 66 is made OFF and is stopped (ST42). Thereafter, the operation proceeds to setting operation (ST43).

In setting operation, one end of the perforated stencil sheet 2 transferred by the perforating operation is clamped by the clamp mechanism 7 of the second drum 5B. Further, the drum 5B is rotated by a predetermined amount in the counterclockwise direction and a terminal end of the stencil sheet 2 is cut by the cutter apparatus 45. Thereafter, the drum 5B is rotated further in the counterclockwise direction of FIG. 1 and the perforated stencil sheet 2 is wound around the peripheral wall 6 of the second drum 5B.

Further, when the perforating operation and operation of setting the stencil sheet 2 have been finished, the operation proceeds to printing operation. In the printing operation, when a number of sheets of printing is inputted by operating ten keys of an operation panel, not illustrated, and thereafter, a start key is depressed, the peripheral walls 6 of the first drum 5A and the second drum 5B are driven to rotate in the counterclockwise direction in synchronism with each other. Simultaneously therewith, the paper drum 13 is driven to rotate in synchronism therewith around a central axis line of its own.

Further, by starting to rotate the peripheral walls 6 of the respective drums 5A and 5B and the paper drum 13, the print sheet 3 is fed, sheet by sheet, from the sheet supply base 22 by the sheet supply roller 24 via the transfer roller 25 to the clamp piece 16 of the paper drum 13 by predetermined timings. The print sheet 3 clamped by the clamp piece 16 of the paper drum 13 is sandwiched between the first drum 5A and the paper drum 13 under predetermined press force along with the stencil sheet 2 wound around the peripheral face of the first drum 5A.

Further, the print sheet 3 is printed with desired image by the stencil sheet 2 wound around the first drum 5A. Thereafter, the print sheet 3 is sandwiched between the second drum 5B and the paper drum 13 under predetermined press force along with the stencil sheet 2 wound around the second drum 5B.

Further, the print sheet 3 is printed with desired image by the stencil sheet 2 wound around the second drum 5B. The print sheet 3 printed with desired image by the stencil sheet 2 wound respectively around the drums 5A and 5B, is separated from the paper drum 13 by the printing sheet separating claw 26. Further, the print sheet 3 is discharged to the print sheet discharge base 29 via the print sheet discharge apparatus 27.

Figure 8:
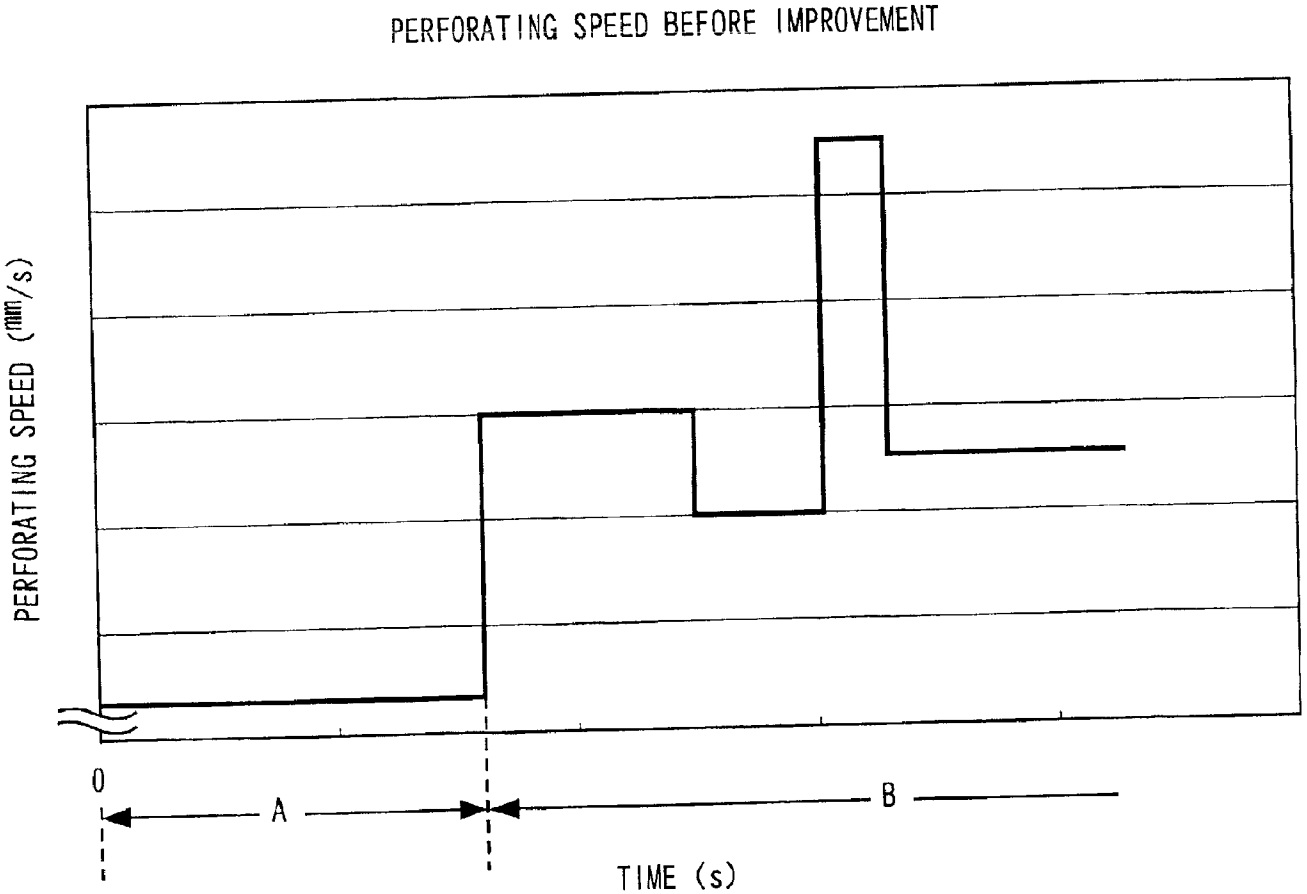
FIG. 8 is a diagram showing stencil speed in the perforating operation on the side of the first drum before improvement according to the stencil printing machine of FIG. 1.
Figure 9:
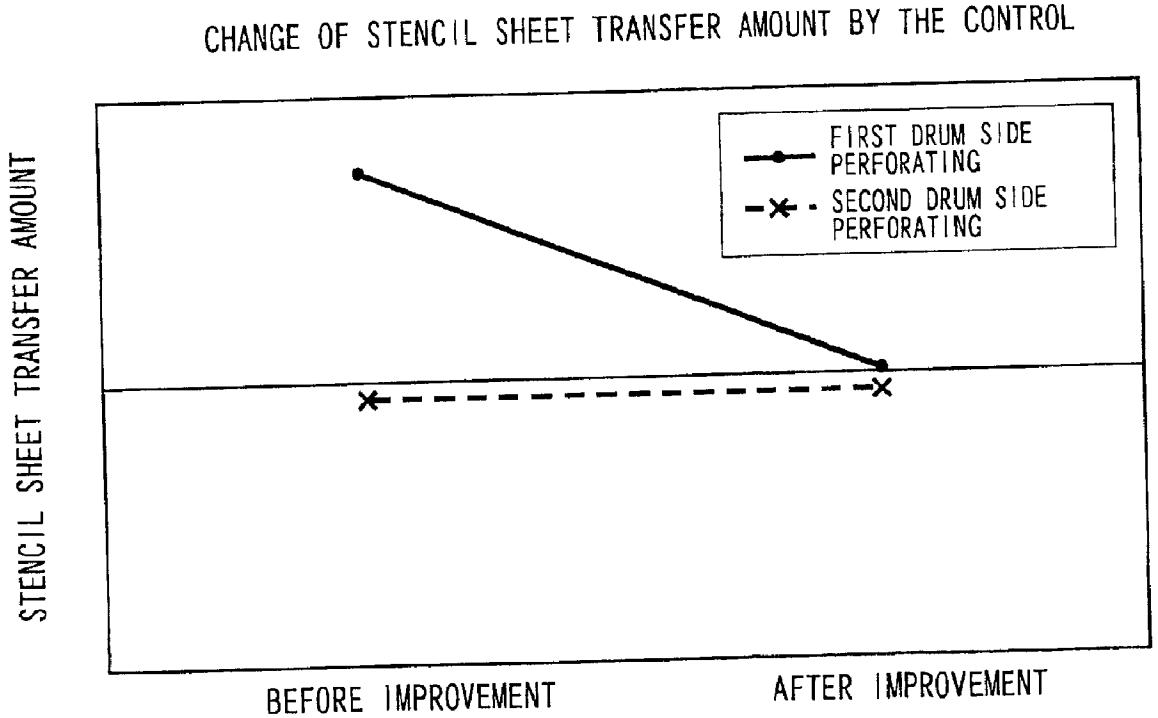
FIG. 9 is a diagram comparing transfer amounts of one edition of stencil sheet before and after the improvement.

Here, FIG. 8 is a diagram showing perforation speed in perforation on the first drum 5A side before improvement in the above-described stencil printing machine 1 and FIG. 9 is a diagram comparing transfer amounts of one edition of the stencil sheet 2 before and after improvement. Further, the transfer speed of the stencil sheet in FIG. 8 is provided by measuring the transfer speed at the position of the transfer roller 57 in FIG. 1 and is regarded to be equal to actual perforation speed. Further, the transfer amounts of the stencil sheet shown in FIG. 9 are average values when six times of perforation is carried out.

When the stencil printing machine 1 having the constitution shown in FIG. 1 is constructed, the feed motor 68 constituting the drive source of the noncommon transfer path 56 is set to be faster than the platen motor 66. Further, the noncommon transfer path 56 of the stencil sheet 2 on the first drum 5A side is longer than the common transfer path 49 of the stencil sheet 2 on the second drum 5B side. Thereby, when the stencil sheet 2 is transferred on the noncommon transfer path 56 on the first drum 5A side, the perforation speed of the stencil sheet 2 becomes faster and the stencil sheet 2 of the perforating section 4 is dragged. Actually, as is apparent from FIG. 8, in comparison with the perforation speed of the stencil sheet 2 in the case of transferring the stencil sheet 2 on the common transfer path 49 (section A of FIG. 8), the perforation speed of the stencil sheet 2 in the case of transferring the stencil sheet 2 on the noncommon transfer path 56 (section B of FIG. 8), is fast. As a result, larger image elongation is caused in perforating the stencil sheet for the first drum 5A larger than in perforating the stencil sheet for the second drum 5B.

Hence, according to the embodiment, in perforating the stencil sheet for the first drum 5A side, it is detected that the stencil sheet 2 passes through the noncommon transfer path 56 and the perforation drive speed of the platen motor 66 is reduced. Thereby, the image elongation in perforating the stencil sheet for the first drum 5A is prevented. Further, in perforating the stencil sheet for the second drum 5B side, the perforation drive speed of the platen motor 66 is not changed.

Further, the transfer amount of the stencil sheet 2 before improvement, differs between the side of the first drum 5A and the second drum 5B side and the image elongation is caused on the first drum 5A side. In contrast thereto, according to the embodiment after improvement, a difference between the transfer amounts of the stencil sheet 2 of the first drum 5A and the second drum 5B is small and the image elongation on the first drum 5A side can be restrained. As shown by FIG. 9, it is known that although before improvement, there is a significant difference between the transfer amounts of the stencil sheet 2 on the first drum 5A and the second drum 5B side, according to the embodiment after improvement, the difference is reduced, the perforation speed becomes constant and the image elongation is restrained.

In this way, according to the embodiment, optimum perforation drive speed is set for respective transfer paths (common transfer path 49, long transfer path 56) of the stencil sheet 2 and the actual perforation speed of the platen motor 66 can be controlled constant while detecting points of passing the stencil sheet 2 by the sensors (stencil sheet awaiting sensors 44, 52, stencil sheet feed sensors 48, 55). Thereby, there can be provided the stencil printing machine in which the stencil sheet is not meandered, the image elongation is eliminated and the perforation time period is not prolonged. Or, even in printing of multiple color and multiple edition, printed matter in which positional shift is not caused can be provided.

Figure 10:
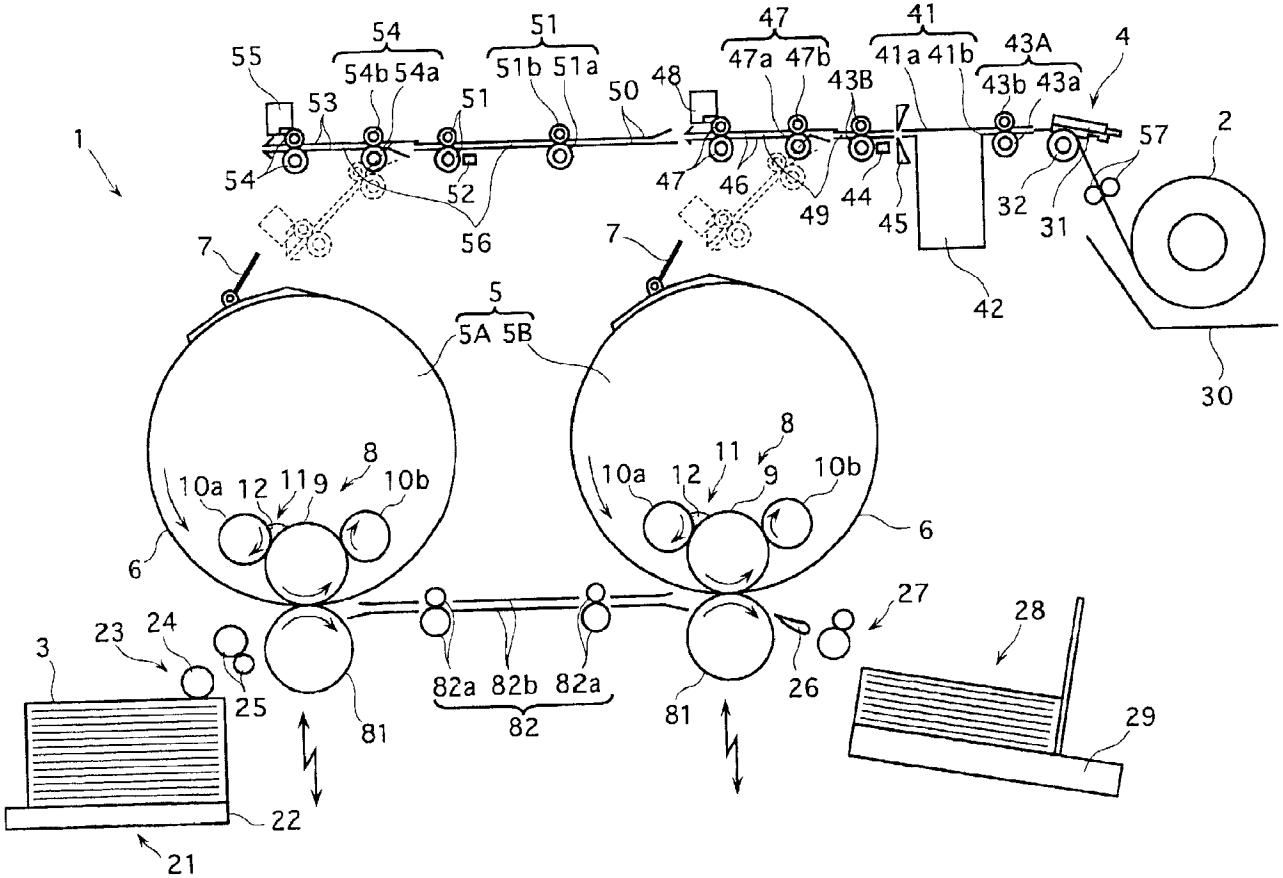
FIG. 10 is a view showing other embodiment of the stencil printing machine according to the present invention.

Meanwhile, the above-described embodiment is not limited to the stencil printing machine having the constitution provided with the paper drum 13 used commonly to the two drums 5A and 5B. For example, the embodiment is applicable to a stencil printing machine as shown by FIG. 10. According to the stencil printing machine, there are arranged press rollers 81 as roller members movable in the up and down direction, in parallel with central axis directions of the respective drums 5A and 5B to be brought into press contact with the peripheral walls 6 of the respective drums 5A and 5B. Further, stencil printing is carried out by bringing the print sheet 3 supplied from the sheet supply section 21 into press contact with the peripheral walls by the press roller 81. At that occasion, delivery of the print sheet 3 from the first drum 5A to the second drum 5B is carried out via a transfer mechanism 82 having a plurality of roller pairs 82*a* and guide plates 82*b* provided between the first drum 5A and the second drum 5B.

Although according to the above-described embodiment, an explanation has been given of an example applied to the case in which stencil printing of two colors is carried out in one operation, the embodiment is applicable also to a stencil printing machine having the constitution having the plurality of drums and stencil printing of multiple colors is carried out in one operation. Further, the embodiment is applicable also to a stencil printing machine having a long transfer path of stencil sheet to a drum and carrying out stencil printing of a single color causing elongation and contraction of image. In this case, there is constructed a constitution in which the first drum 5A is removed and only the second drum 5B is provided. Therefore, the transfer path becomes only the noncommon transfer path 56. Further, the detecting means is constituted by the upstream side stencil sheet awaiting sensor 44 and the upstream side stencil sheet feed sensor 48.

Further, although according to the above-described embodiment, there is constructed the constitution in which passing of the stencil sheet 2 transferred on the transfer path (common transfer path 49, noncommon transfer path 56), is detected by the plurality of sensors (stencil sheet awaiting sensors, stencil sheet feed sensors), the passing of the stencil sheet 2 may be detected as an amount of feeding the stencil sheet from a predetermined position based on an output of an encoder connected to the feed motor 68.

As is apparent from the above-described explanation, according to the invention, the actual perforation speed of the platen motor can be controlled constant while detecting the passing points of the stencil sheet by setting the perforation speed optimum to the respective transfer paths (common transfer path, noncommon transfer path) of the stencil sheet. Thereby, there can be provided the stencil printing machine in which the stencil sheet is not meandered, the image elongation is eliminated and the perforation time period is not prolonged. Further, even in the multiple color multiple edition printing, printed matter in which positional shift is not caused can be provided.

What is claimed is:

1. A stencil sheet transfer method of a stencil printing machine, comprising the steps of:

perforating a desired image while transferring a stencil sheet;

transferring the stencil sheet being perforated at a predetermined speed on a transfer path of the stencil sheet;

detecting passing of the stencil sheet at predetermined positions of the transfer path and reducing a speed of transferring the stencil sheet less than the predetermined speed while further transferring the sheet and continuing to perforate the desired image on the stencil sheet; and winding the perforated stencil sheet around a drum in a cylindrical shape.

2. A stencil sheet transfer method according to claim 1, wherein said reduced speed less than the predetermined speed is more than zero.

3. A stencil sheet transfer method of a stencil printing machine comprising the steps of:

perforating a desired image while transferring a stencil sheet;

transferring the perforated stencil sheet at a predetermined speed on a transfer path of the perforated stencil sheet comprising a common transfer path used commonly by all of drums when the perforated stencil sheet is transferred to and wound around any one of a plurality of the drums in a cylindrical shape and a noncommon transfer path communicated with the common transfer path;

detecting passing of the stencil sheet at the common transfer path and the noncommon transfer path and reducing a transfer speed of the stencil sheet when the stencil sheet is determined to be transferred to a boundary between the common transfer path and the noncommon transfer path; and winding the stencil sheet around one of the plurality of drums in a cylindrical shape where the stencil sheet can reach by passing through the common transfer path and the noncommon transfer path.

* * * * *